US005244191A

United States Patent [19]

Kanekura

[11] Patent Number: 5,244,191

[45] Date of Patent: Sep. 14, 1993

[54] SHEET FEEDING APPARATUS FOR IMAGE RECORDING SYSTEM

[75] Inventor: Kazunori Kanekura, Fukuoka, Japan

[73] Assignee: Matsushita Electric Industrial Co., Ltd., Osaka, Japan

[21] Appl. No.: 909,666

[22] Filed: Jul. 7, 1992

[30] Foreign Application Priority Data

Jul. 8, 1991 [JP] Japan ..... 3-166744
Sep. 17, 1991 [JP] Japan ..... 3-236046

[51] Int. Cl.[5] ..... B65H 5/00

[52] U.S. Cl. ..... 271/10; 271/118; 271/124; 271/126

[58] Field of Search ..... 271/117, 118, 121, 124, 271/126, 127, 10

[56] References Cited

U.S. PATENT DOCUMENTS 4,717,139 1/1988 Sootome et al. ..... 271/126 X

FOREIGN PATENT DOCUMENTS 0102444 6/1982 Japan ..... 271/121
0039641 3/1984 Japan ..... 271/10
0048844 3/1985 Japan ..... 271/126
0116437 5/1987 Japan ..... 271/126
0191337 8/1987 Japan ..... 271/121
0295844 12/1987 Japan ..... 271/127
2-99366 4/1990 Japan .
0051236 3/1991 Japan ..... 271/126
3-102019 4/1991 Japan ..... 271/121
8500348 1/1985 PCT Int'l Appl. .
1424580 2/1976 United Kingdom .
2219281 12/1989 United Kingdom .

*Primary Examiner*—H. Grant Skaggs
*Assistant Examiner*—Carol Lynn Druzbick
*Attorney, Agent, or Firm*—Pollock, VandeSande & Priddy

[57] ABSTRACT

A sheet feeding apparatus for successively supplying, by one, sheets piled up within a sheet storing device up to an image formation apparatus along a predetermined sheet supplying direction. The sheet feeding apparatus is equipped with a sheet feeding roller driven to rotate about a roller rotating shaft to pick up the sheets from the sheet storing device and a separation device disposed at a downstream side of the sheet storing device and in opposed relation to the sheet feeding roller. The separation device is pressed by a spring toward the sheet feeding roller to be brought into contact therewith so that the sheets picked up from the sheet storing device are pressed against the sheet feeding roller so as to be frictionally separated from each other and fed by one in accordance with the rotation of the sheet feeding roller toward a downstream side. The sheet storing device is also pressed by a spring toward the sheet feeding roller so that the sheets can be brought into contact with the sheet feeding roller to be picked up therefrom. Also included in the apparatus is a releasing device operable in accordance with the rotation of the sheet feeding roller for releasing the pressed state of the sheets against the sheet feeding roller and for releasing the pressed state of the separation device against the sheet feeding roller when sheet feeding roller rotates by a predetermined rotational angle. This arrangement allows reduction of parts to reduce the cost and size of the apparatus.

20 Claims, 8 Drawing Sheets

SHEET FEEDING APPARATUS FOR IMAGE RECORDING SYSTEM

BACKGROUND OF THE INVENTION

The present invention relates to an apparatus for feeding a sheet-like members (which will be referred hereinafter to as sheets) in image recording system such as a printer, a copying machine and a facsimile equipment.

A conventional sheet feeding apparatus will be described hereinbelow with reference to FIGS. 11 to 13. In FIG. 11, the sheet feeding apparatus comprises a sheet feeding roller 27 having a substantially cylindrical configuration for successively feeding sheets 33 placed one upon another, a portion of which is cut off in the directions of the axis of a roller rotating shaft 3. This sheet feeding roller 27 is supported by the roller rotating shaft 3 and a one-revolution clutch (not shown) is incorporated into the roller rotating shaft 3. Also included in the sheet feeding apparatus is a separation pad 8 provided within the sheet feeding apparatus so as to be supported to be movable in directions indicated by an arrow F. This separation pad 8 is biased toward the sheet feeding roller 27 side by means of a spring 9. Further, included in the apparatus is a separation idler roller 28 rotatably supported by the roller rotating shaft 3 and having a radius slightly smaller than the radius of the sheet feeding roller 27. When the cut-off portion of the sheet feeding roller 27 moves in accordance with its rotation to face the separation pad 8, the separation idler roller 28 comes into contact with the separation pad 8. Designated at numeral 6 is a sheet storing (keeping) device end portions of which are slidably (movably) supported within the apparatus. This sheet storing device 6 is biased by means of a spring 7 toward the sheet feeding roller 27 side. Further, numeral 29 represents an upper guide for guiding the sheets 33 in conveying, numeral 30 represents an lower guide for the sheet 33 in conveying, and numerals 31, 32 are conveying rollers for conveying sheets 33, separated one by one through the sheet feeding roller 27 and fed therefrom, toward an image formation apparatus (not shown) which is disposed at a downstream portion in the conveying direction. Here, when the frictional forces between the sheet feeding roller 27 and the sheet 33, between the separation pad 8 and the sheet 33 and between the sheets 33 are respectively taken to be Q, R and S, the relation between the frictional forces is $Q>R>S$.

A description will be made hereinbelow in terms of the operation of the conventional sheet feeding apparatus thus arranged. In the case of no feeding and conveying of the sheets 33, as illustrated in FIG. 11, the relation in position between the sheet feeding roller 27, the separation pad 8, the separation idler roller and the sheets 33 is that the sheet feeding roller 27 stops with the cut-off portion thereof being positioned at the lower side and the separation pad 8 is brought into contact with the separation idler roller 28 by means of the biasing force of the spring 9. This separation idler roller 28 also comes into contact with the sheets 33 held within the sheet storing device 6 because the sheet storing device 6 is biased upwardly by the spring 7. For starting the sheet feeding operation, the sheet feeding roller 27 is rotated in a direction indicated by an arrow G so as to come into contact with the sheet 33. When the sheet feeding roller 27 further rotates, as illustrated in FIG. 12, the sheet feeding roller 27 downwardly presses the separation pad 8 so that the sheets 33 are supplied toward between the sheet feeding roller 27 and the separation pad 8. At this time, only the uppermost sheet **33*a* of the sheets 33 is fed due to the difference between the frictional forces of the separation pad 8 and sheet feeding roller 27 with respect to the sheet 33**.

When supplying the sheet **33*a*, due to the one-revolution clutch the sheet feeding roller 27 operates by one revolution to convey the sheet 33*a* by a predetermined distance and then stops to take a state as illustrated in FIG. 13. The conveying distance corresponding to the one revolution of the sheet feeding roller 27 is set to be longer than the distance between the conveying rollers 31, 32 and the sheet feeding roller 27. After being conveyed by the sheet feeding roller 27, the sheet 33*a* is supplied into an image formation apparatus (not shown). At this time, although the sheet 33*a* is brought into contact with the separation idler roller 28 by means of the separation pad 8, the separation idler roller 28 is rotatably supported by the roller rotating shaft 3 so as to be rotated in accordance with the movement of the sheet 33*a*, thus not affecting the conveying of the sheet 33*a*. After the completion of the conveying of the sheet 33*a*, the sheet feeding roller 27** again starts to rotate to perform the similar sheet feeding and separating operation.

As obvious from the above description, such a conventional sheet feeding apparatus requires two conveying means, i.e., the sheet feeding roller 27 and the conveying rollers 31, 32, for the separation and feeding of the sheet **33*a***. This causes increase in cost and size of the apparatus.

SUMMARY OF THE INVENTION

It is therefore an object of the present invention to provide a sheet feeding apparatus which is capable of reducing the number of parts to decrease the manufacturing cost and the size of the apparatus.

In accordance with the present invention, there is provided a sheet feeding apparatus for successively supplying, by one, sheets piled up within a sheet storing device up to an external apparatus along a predetermined sheet supplying direction, the apparatus comprising: sheet feeding roller means rotationally driven by driving means; first pressing means for pressing the sheet storing device toward the sheet feeding roller means so that the sheets can be pressed against the sheet feeding roller means so as to be picked up and fed from the sheet storing device; separation means disposed at a downstream side of the sheet storing device and in opposed relation to the sheet feeding roller means, the separation means being pressed by a second pressing means toward the sheet feeding roller means to be brought into contact with the sheet feeding roller means so that the sheets picked up from the sheet storing device are pressed against the sheet feeding roller means so as to be frictionally separated from each other and fed by one in accordance with the rotation of the sheet feeding roller means toward a downstream side; non-driven roller means disposed at a downstream side of the separation means and arranged to be brought into contact with the sheet feeding roller means so as to be rotatable in accordance with the rotation of the sheet feeding roller means, the non-drive roller means, in cooperation with the sheet feeding roller means, further feeding the sheet separated by the separation means to a down stream side; first releasing means for releasing the pressed state of the sheets against the sheet feeding roller means after the sheet separated by the separation means reaches the non-driven roller means; and second releasing means for releasing the pressed state of the separation means against the sheet feeding roller means.

Further, according to this invention there is provided a sheet feeding apparatus for successively supplying, by one, sheets piled up within a sheet storing device up to an external apparatus along a predetermined sheet supplying direction, the apparatus comprising: sheet feeding roller means driven by driving means to rotate about a roller rotating shaft; first pressing means for pressing the sheet storing device toward the sheet feeding roller means so that the sheets can be pressed against the sheet feeding roller means so as to be picked up and fed from the sheet storing device; separation means disposed at a downstream side of the sheet storing device and in opposed relation to the sheet feeding roller means, the separation means being pressed by a second pressing means toward the sheet feeding roller means to be brought into contact with the sheet feeding roller means so that the sheets picked up from the sheet storing device are pressed against the sheet feeding roller means so as to be frictionally separated from each other and fed by one in accordance with the rotation of the sheet feeding roller means toward a downstream side; first releasing means operable in accordance with the rotation of the sheet feeding roller means for releasing the pressed state of the sheets against the sheet feeding roller means when the sheet feeding roller means rotates by a first predetermined rotational angle; and second releasing means operable in accordance with the rotation of the sheet feeding roller means for releasing the pressed state of the separation means against the sheet feeding roller means when the sheet feeding roller means rotates by a second predetermined rotational angle.

Preferably, the second releasing means comprises roller means having a through-hole into which the roller rotating shaft of the sheet feeding roller means is inserted, the second releasing roller means being arranged to be movable in a first direction of the separation means and in a second direction opposite to the direction of the separation means so that, when being moved in the first direction of the separation means, the second releasing roller means presses the separation means against the second pressing means to separate the separation means from the sheet feeding roller means. The second releasing roller means is moved in the first and second directions by cam means fixedly attached to the roller rotating shaft of the sheet feeding roller means and positioned within the through-hole of the second releasing roller means, the cam means being arranged to contact with a surface of the through-hole of the second releasing roller means so as to move the second releasing roller means in the first and second directions. Moreover, the first releasing means comprises cam means fixedly attached to the roller rotating shaft of the sheet feeding roller means so as to be rotatable in accordance with the rotation of the sheet feeding roller means, the cam means being arranged to press the sheet storing device against the first pressing means when the roller rotating shaft rotates by a predetermined rotational angle so as to release the sheets from the pressed state against the sheet feeding roller means. More preferably, the second releasing means has stopper means engageable with the cam means when the roller rotating shaft of the sheet feeding roller means rotates by the second predetermined rotational angle to stop the rotation of cam means when a rotational force of the cam means is below a predetermined value.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
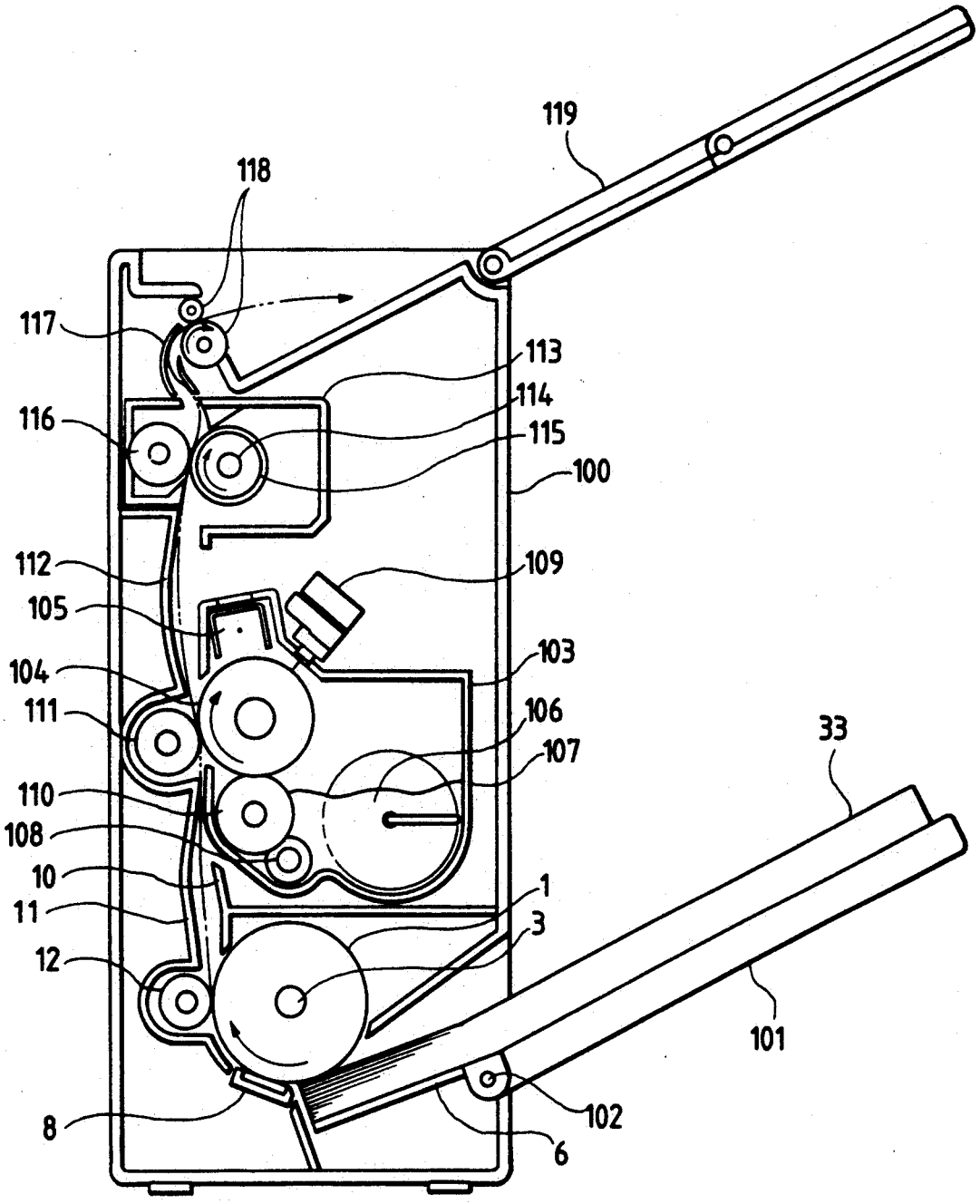
FIG. 1 a cross-sectional view showing a sheet feeding apparatus according to a first embodiment of this invention which is incorporated into an image recording system.

Referring now to FIGS. 1 to 7, a description will be made hereinbelow in terms of a sheet feeding apparatus for an image recording system according to a first embodiment of the present invention. In FIG. 1, numeral 100 represents a housing for an image recording system arranged to be engageable with a sheet storing device 6 and a sheet feeding tray 101 which are coupled to each other through a hinge 102 so as to be rotatable about the hinge 102. At a position between an image formation apparatus of the image recording system and the sheet storing device 6 there is provided a sheet feeding apparatus comprising a sheet feeding roller assembly 1 for picking up sheets 33, stored in the sheet storing device 6, one by one and feeding the sheets 33 toward the image formation apparatus, a separation pad 8 for separating the sheets 33 by one in cooperation with the sheet feeding roller assembly 1, upper and lower guides 10, 11 for guiding the sheets 33 fed from the sheet feeding roller assembly 1, and a non-driven (following) conveying roller 12 rotatably supported by the housing 100 and positioned to come into contact with the sheet feeding roller assembly 1 so as to be rotatable in accordance with the rotation of the sheet feeding roller assembly 1. Further, numeral 103 designates a cartridge encasing the image formation apparatus comprising an image holding device 104 equipped with an conductive drum having on its surface an inorganic or organic photoconductive layer, a charging device 105 for evenly giving negative charge the surface of the image holding device 104 by means of the corona discharge, an agitator 107 for agitating a toner 106, a supply roller 108 for supplying the toner 106, and a developing roller 110 for developing an electrostatic latent image, formed on the image holding device 104 by means of a light beam from an LED print head 109, with the toner 106 layered by the supply roller 108. The cartridge 103 is arranged to be detachable from the housing 100 of the image recording system so as to be exchangeable with a new one. Further, numeral 111 a transfer roller for transferring the toner image on the image holding device 104 onto the sheet 33 supplied from the sheet feeding roller 1, numeral 112 depicts a guide, and numeral 113 denotes a fixing device for fixing the transferred toner image on the sheet 33. The fixing device 113 comprises a fixing rotating body 115 having therein a heating source such as a halogen lamp 114 and a rotating body 116 positioned in opposed relation to the fixing rotating body 115 and biased thereto by a constant pressing force. Moreover, numeral 117 represents a guide, numeral 118 designates a pair of sheet-discharging rollers for discharging the sheet 33 from the fixing device 113, numeral 119 denotes a discharged sheet tray for storing the discharged sheet 33 through the pair of sheet-discharging rollers 118.

As illustrated in FIG. 1, the sheet feeding apparatus, the image formation apparatus, the fixing device 113 and the sheet-discharging device are vertically arranged, thereby constructing a small-sized image recording system.

A description will be made hereinbelow with reference to FIGS. 2 to 7 in terms of an arrangement of the sheet feeding apparatus. In FIGS. 2 to 7, the sheet feeding roller assembly 1 is arranged to be rotatable about a roller rotating shaft 3, and the separation pad 8 is disposed in opposed relation to the sheet feeding roller assembly 1 and arranged to be slidable in directions indicated by an arrow F. This separation pad 8 is always biased (or urged) by a spring 9 toward the sheet feeding roller assembly 1 side. The roller rotating shaft 3 is equipped with a cam assembly 2 comprising two cam members 2a and 2b. The roller rotating shaft 3 is inserted into an separation idler roller assembly 5 comprising two separation idler rollers 5a and 5b which is rotatably supported by an idler roller bracket assembly 4 comprising two brackets 4a and 4b. The two brackets 4a and 4b are engaged with restriction members 14a and 14b, fixed to the housing 100 of the image recording system, so as to be movable only in directions indicated by arrows A and B. The sheet storing device 6 is biased toward the sheet feeding roller assembly 1 side by means of a spring 7 and the non-driven conveying roller 12 is also biased toward the sheet feeding roller assembly 1 side by means of a spring 13. Here, when the frictional forces between the sheet feeding roller assembly 1 and the sheet 33, between the separation pad 8 and the sheet 33 and between the sheets 33 are respectively taken as T, R and S, the relation between the frictional forces T, R and S is set to be $T>R>S$.

Figure 6:
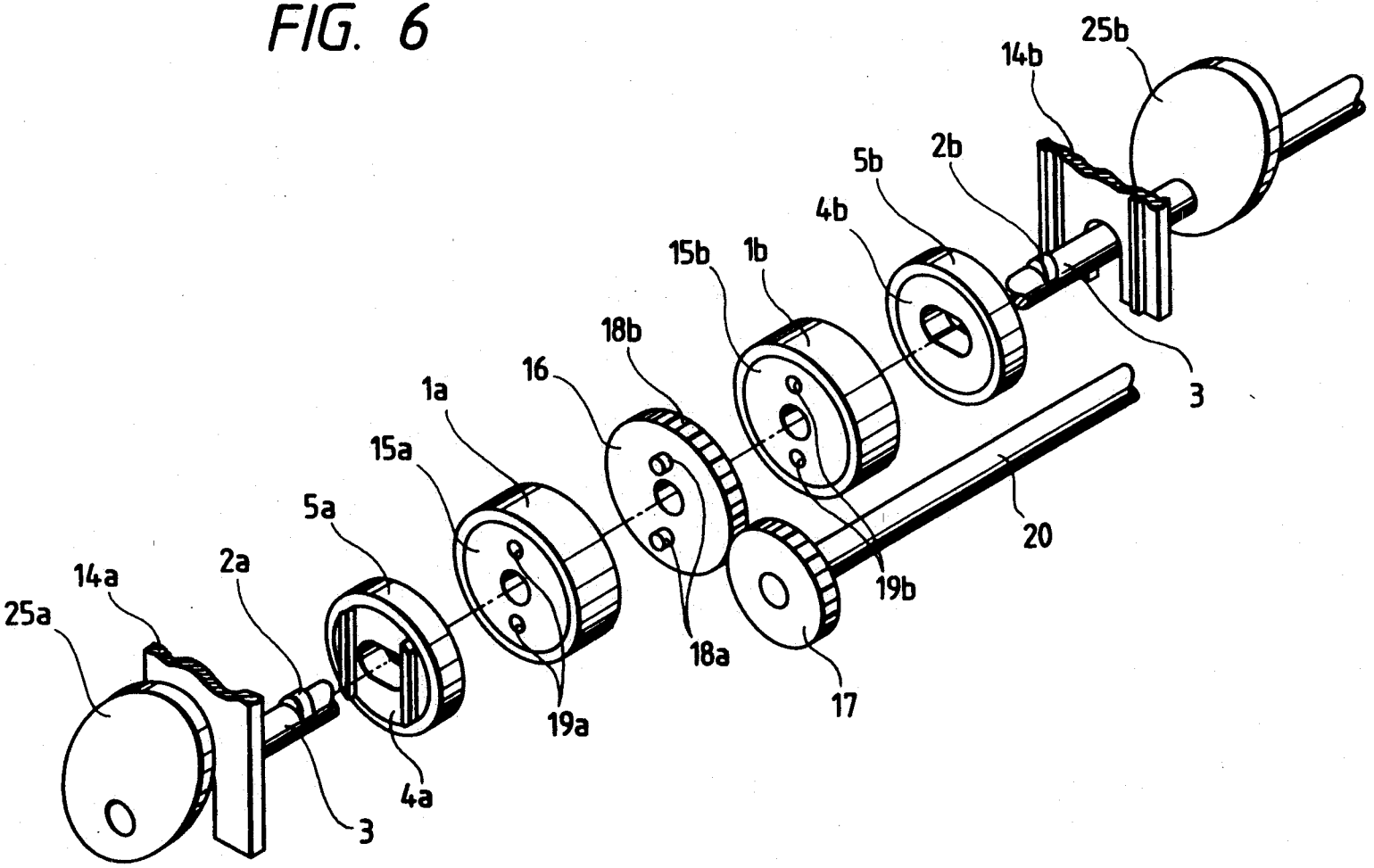

In FIG. 6, the sheet feeding roller assembly 1 comprises two sheet feeding rollers 1a and 1b which are supported by sheet feeding roller brackets 15a and 15b which are in turn supported rotatably by the roller rotating shaft 3. The sheet feeding roller brackets 15a and 15b respectively have holes 19a and 19b. The roller rotating shaft 3 also supports a toothed wheel 16 so that the toothed wheel 16 is rotatable about the roller rotating shaft 3. This toothed wheel 16 has pins 18a and 18b which are arranged to be engaged with the holes 19a and 19b of the sheet feeding roller brackets 15a and 15b whereby the sheet feeding rollers 1a and 1b are coupled to each other through the toothed wheel 16 so as to constitute the sheet feeding roller assembly 1. The toothed wheel 16 is engaged with a toothed wheel 17 connected to a gear shaft 20 whereby rotation of the gear shaft 20 can be delivered through the toothed wheel 17 to the sheet feeding roller assembly 1 comprising the sheet feeding rollers 1a and 1b. Further, the roller rotating shaft 3 is at its both end portions equipped with cam members 25a and 25b.

Figure 7:
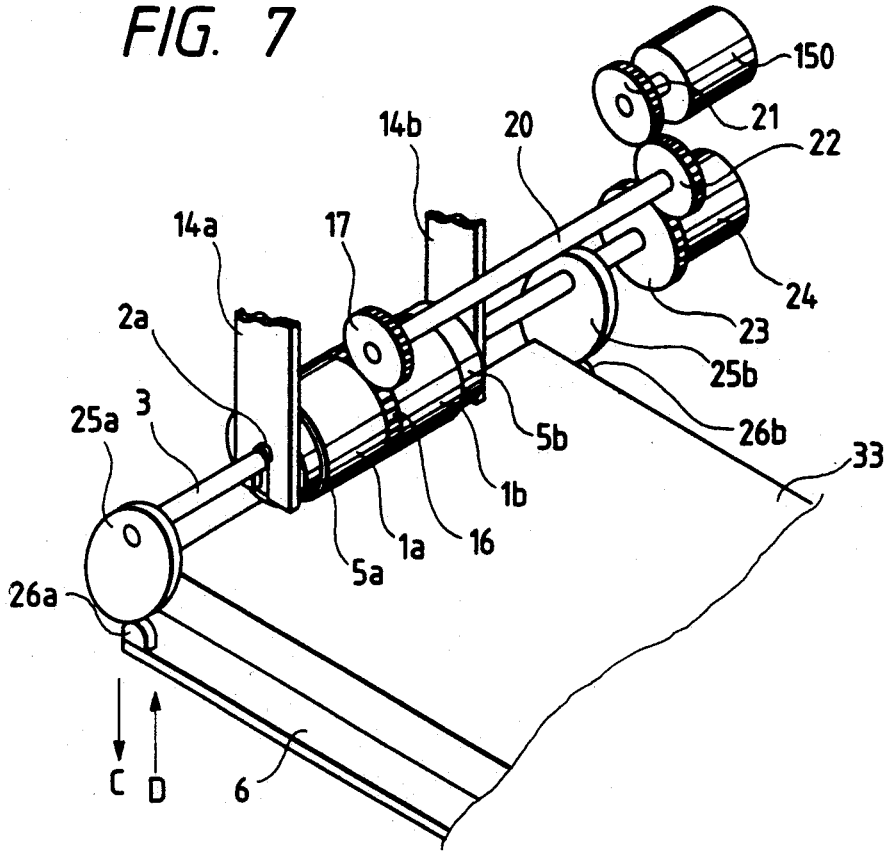

In FIG. 7, rotation of a drive motor 150 can be arranged to be delivered through toothed wheels 21 to 23 to the roller rotating shaft 3. The toothed wheel 21 is attached to a rotating shaft of the drive motor 150, the toothed wheel 22 is attached to one end of the above-mentioned gear shaft 20 the other end of which is attached to the toothed wheel 17, and the toothed wheel 23 is coaxially attached to the roller rotating shaft 3. Numeral 24 represents a one-revolution clutch for performing the engagement between the toothed wheel 23 and the roller rotating shaft 3 and effecting the disengagement therebetween. This one-revolution clutch 24 is driven in response to an electric signal from the image formation apparatus side so that the roller rotating shaft 3 rotates by one revolution from the state that the roller rotating shaft 3 is in the disengaged relation to the toothed wheel 23. The cam members 25a and 25b fixedly attached to the roller rotating shaft 3 are respectively arranged to depress projections 26a and 26b provided on the sheet storing device 6 in accordance with the rotation of the roller rotating shaft 3 whereby the sheet storing device 6 is movable in directions indicated by arrows C and D.

Figure 2:
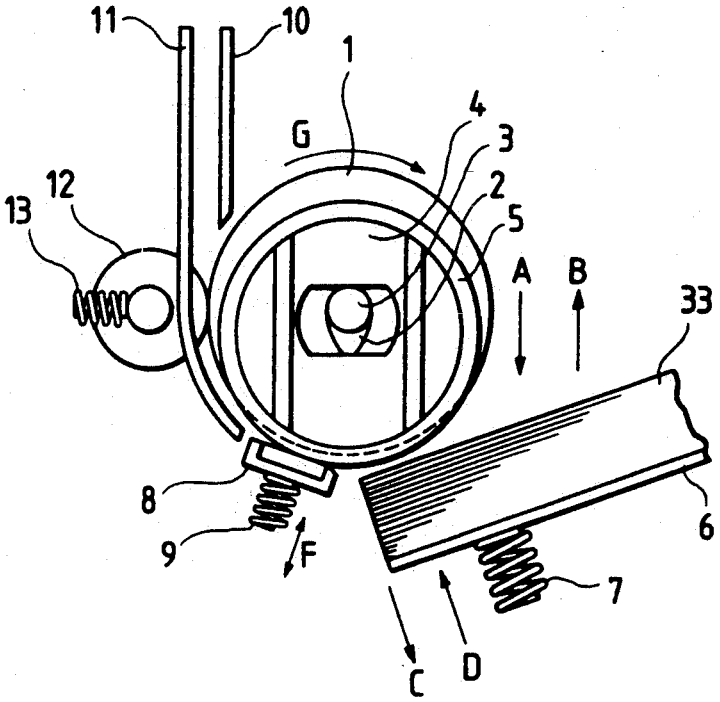
FIGS. 2 to 7 are illustrations for describing an arrangement and an operation of the sheet feeding apparatus according to the first embodiment of this invention.
Figure 3:
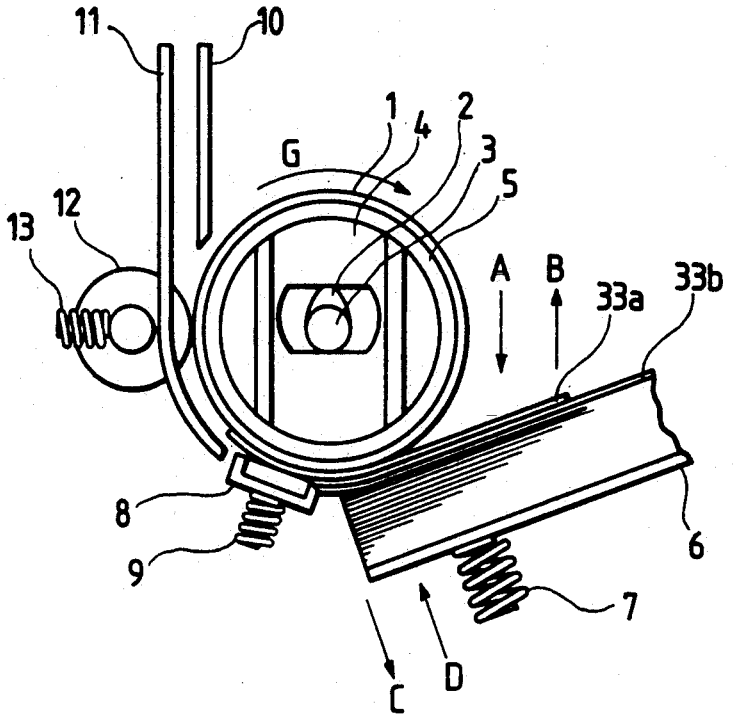

In addition, the operation of the sheet feeding apparatus of this embodiment will be described hereinbelow. First, in the case of no feeding and conveying operation of the sheet 33, the positional relation between the sheet feeding roller assembly 1, the separation pad 8, the separation idler roller assembly 5 and the sheet 33 is taken as illustrated in FIG. 2. That is, the idler roller bracket assembly 4 is pressed downwardly by means of the cam assembly 2 whereby the separation idler roller assembly 5 is moved in the arrow A direction so as to be brought into contact with the separation pad 8 which is biased by the spring 9 toward the separation idler roller assembly 5 side. On the other hand, since the sheet storing device 6 is moved in the arrow C direction with the projections 26a and 26b being depressed by the cam members 25a and 25b, the separation idler roller assembly 5 is not brought into contact with the sheet 33 placed in the sheet storing device 6. At this time, the sheet feeding roller assembly 1 does not come into contact with the separation pad 8 and the sheet 33, thus preventing the supply of the sheet 33 irrespective of the rotation of the sheet feeding roller assembly 1.

Secondly, In response to the electric signal from the image formation apparatus side, the one-revolution clutch 24 engages the toothed wheel 23 with the roller rotating shaft 3 to rotate the roller rotating shaft 3 whereby the cam assembly 3 and the cam members 25a and 25b also rotate. In accordance with the rotations of the cam assembly 3 and the cam members 25a and 25b, the separation idler roller means 5 moves in the arrow B direction and the sheet storing device 6 moves in the arrow D direction, thereby taking the state illustrated in FIG. 3. That is, the sheet feeding roller assembly 1 comes into contact with the separation pad 8 and the sheet 33. In this state, the sheet feeding roller assembly 1 is rotated whereby due to the difference between the frictional forces of the sheet feeding roller assembly 1 and the separation pad 8 with respect to the sheet 33 only the uppermost sheet 33a of the sheets 33 is fed toward between the sheet feeding roller assembly 1 and separation pad 8.

Figure 4:
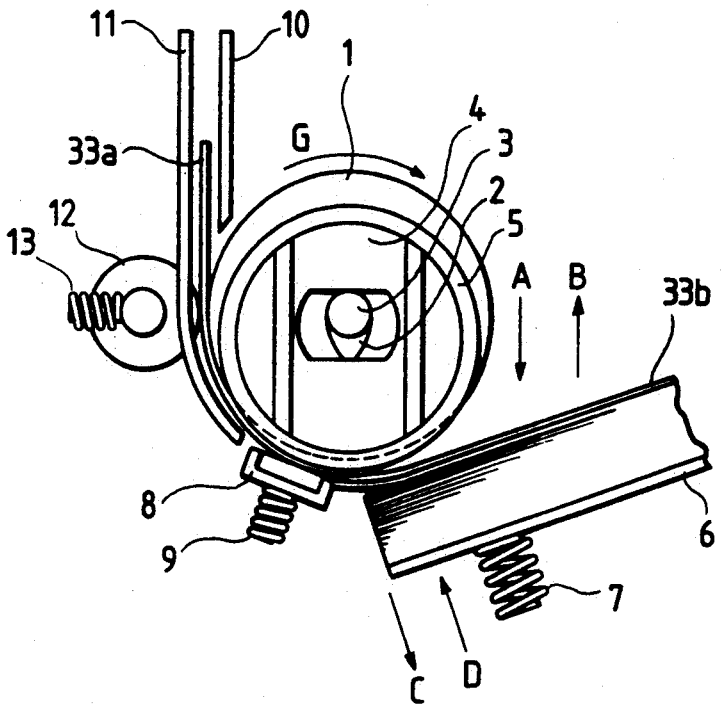

Further, the roller rotating shaft 3 is rotated whereby the separation idler roller assembly 5 is moved in the arrow A direction due to the cam assembly 2 and the sheet storing device 6 is moved in the arrow C direction due to the cam members 25*a* and 25*b*, thereby taking the state illustrated in FIG. 4. Here, the toothed wheel 23 and the roller rotating shaft 3 are disengaged with each other to stop the rotation of the roller rotating shaft 3. At this time, the sheet feeding roller assembly 1 is separated from the separation pad 8 and the sheet 33 encased in the sheet storing device 6 to stop the supply of the next sheet 33*b*, while the sheet 33*a* is placed between the sheet feeding roller assembly 1 and the non-driven conveying roller 12 and then conveyed toward a contact position between the image holding device 104 and the transfer roller 111. Here, the sheet 33*a* is pressed by the separation pad 8 against the separation idler roller assembly 5 and the separation idler roller assembly 5 is rotated in accordance with the movement of the sheet 33*a* so as not to affect the conveying operation of the sheet 33*a*. After the completion of the conveying operation of the sheet 33*a*, the roller-rotating shaft 3 is again rotated so as to similarly separate and feed the next sheet 33.

Figure 5:
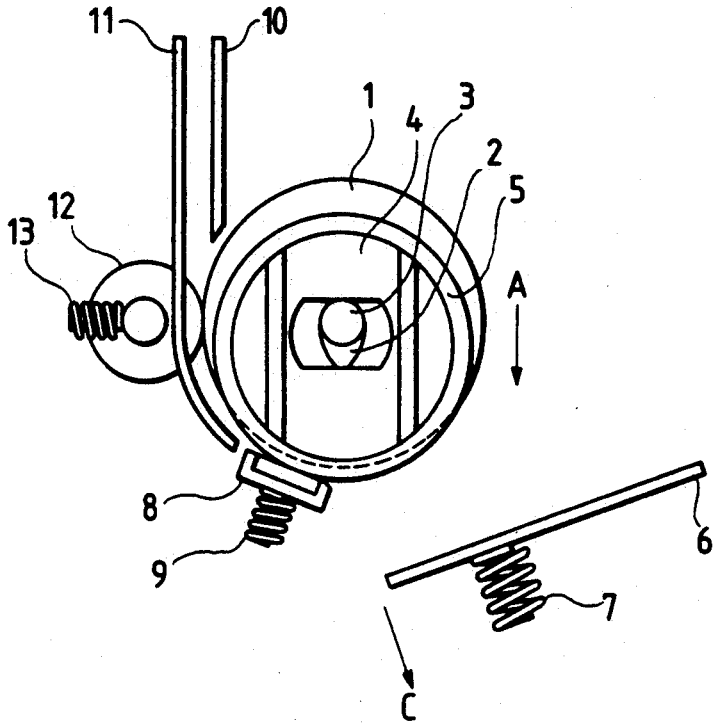

Moreover, in the case that the sheet feeding operation stops as illustrated in FIG. 5 because of use-up of the sheets 33 in the sheet storing device 6, the sheet storing device 6 take the moved state in the arrow C direction by means of the cam members 25*a* and 25*b* whereby the separation idler roller assembly 5 does not come into contact with the sheet storing device 6. This make easy the supply of new sheets 33 to the sheet storing device 6.

As described above, according to the first embodiment of this invention, in response to the rotation of the roller rotating shaft 3, the separation idler roller assembly 5 moves to cause the contact and separation between the separation idler roller assembly 5 and the separation pad 8 wherey the sheet feeding roller asembly 1, being always rotated through the gear shaft 20 and the toothed wheel 16, contacts and detach with and from the separation pad 8 so that the sheets 33 are separated and fed by one and then conveyed by a combination of the sheet feeding roller assembly 1 and non-driven conveying roller 12. This arrangement allows that the sheet feeding roller assembly 1 performs the separation, feeding and vonveying of the sheet 33 up to the image formation apparatus, and hence independent separation roller and conveying roller are not required to be provided, thereby reducing the cost and size of the apparatus.

Figure 8:
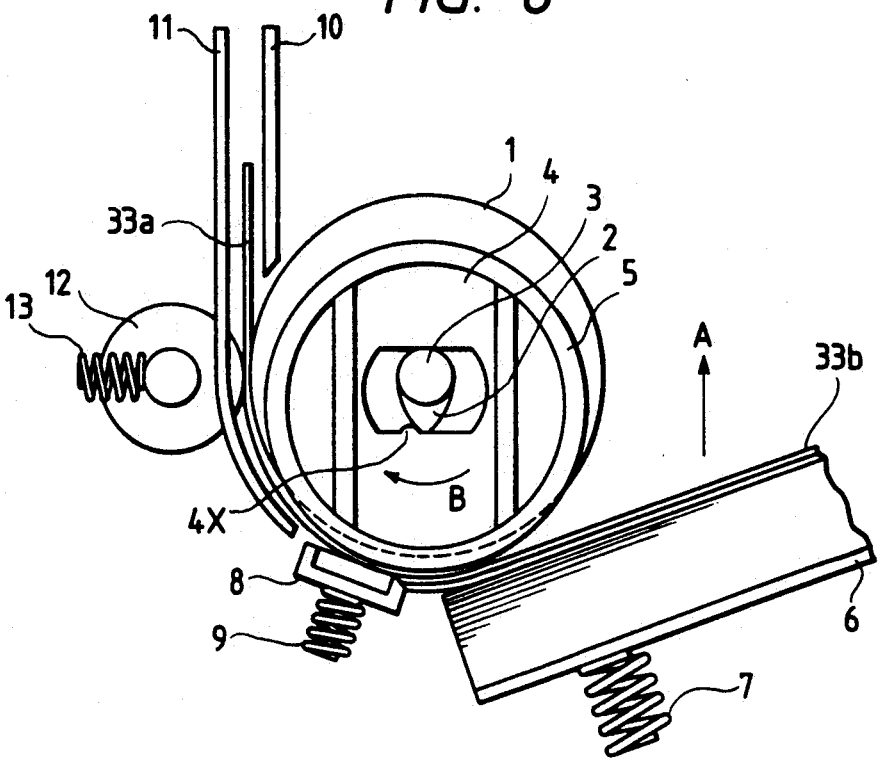
FIG. 8 is an illustration of an arrangement of a sheet feeding apparatus according to a second embodiment of this invention.

Moreover, a description will be made hereinbelow with reference to FIG. 8 in terms of a second embodiment of this invention which relates to an arrangement for making stable the operation of the cam assembly 2. In FIG. 8, parts corresponding to those in FIGS. 1 to 7 are marked with the same numerals. Designated at reference 4X is a projection for stopping the rotation of the cam assembly 2 in a direction indicated by an arrow B which can occur when the idler roller bracket assembly 4 is pressed in a direction indicated by an arrow A in the case that the roller rotating shaft 3 is stopping due to the operation of the one-revolution clutch 24. When the sheet 33*a* reaches a position illustrated in FIG. 8, the rotation of the roller rotating shaft 3 is stopped by the disengaging operation of the one-revolution clutch 24 so that the sheet 33*a* stops at that position. At this time, the cam assembly 2 is prevented by the projection 4X from being rotated in the arrow B direction, and therefore the separation idler roller assembly 5 is moved upwardly even if being pressed in the arrow A direction. This can prevent the next sheet 33*b* from being fed except for the case that the rotation of the roller rotating shaft 3 again starts. Secondly, when the roller rotating shaft 3 starts to rotate by means of the one-revolution clutch 24 so that the cam assembly 2 follows (goes up) the projection 4X and rotates in the arrow B direction, the separation idler roller assembly 5 moves upwardly in the arrow A direction so that the sheet feeding roller assembly 1 comes into contact with the sheet 33 to start the sheet feeding operation.

As described above, according to the second embodiment of this invention, since the projection 4X is provided which stops the rotation of the cam assembly 2 in the arrow B direction when the idler roller bracket assembly 4 is pressed in the arrow A direction, in the case that the separation idler roller assembly 5 is pressed against the sheet 33 to stop the feeding of the sheet 33, it is possible to prevent the separation idler roller assembly 5 from being released from the pressed state to perform the sheet feeding operation.

Figure 9:
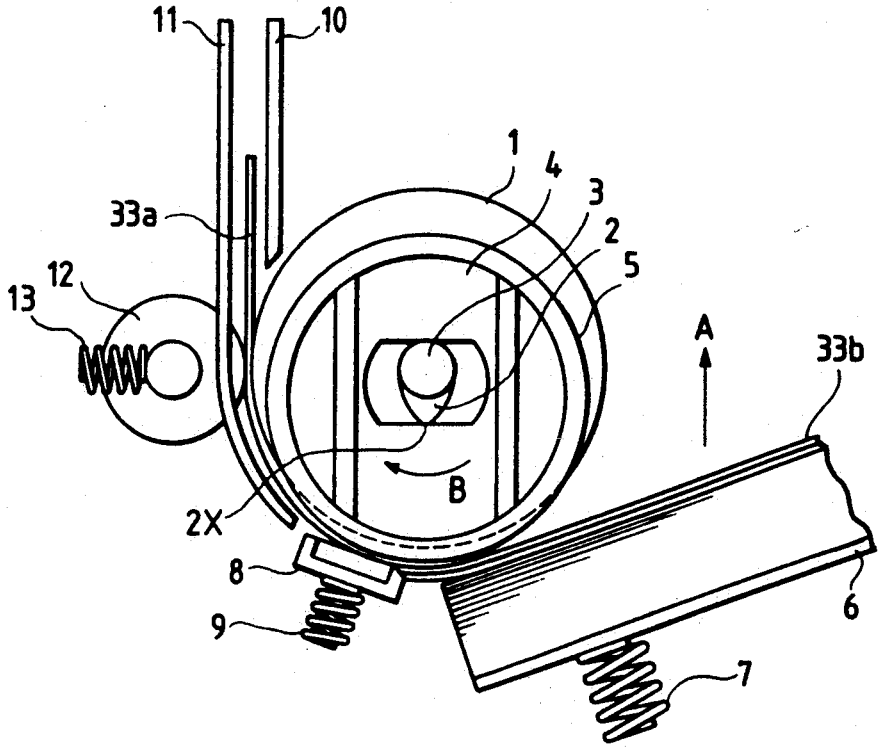
FIG. 9 is an illustration of an arrangement of a sheet feeding apparatus according to a third embodiment of this invention.

FIG. 9 shows a third embodiment of this invention. The third embodiment is arranged such that a flat portion 2X is formed at the distal portion of the cam assembly 2 as illustrated in FIG. 9. This flat portion 2X can offer the same effect as the projection 4X in the aforementioned second embodiment.

Figure 10:
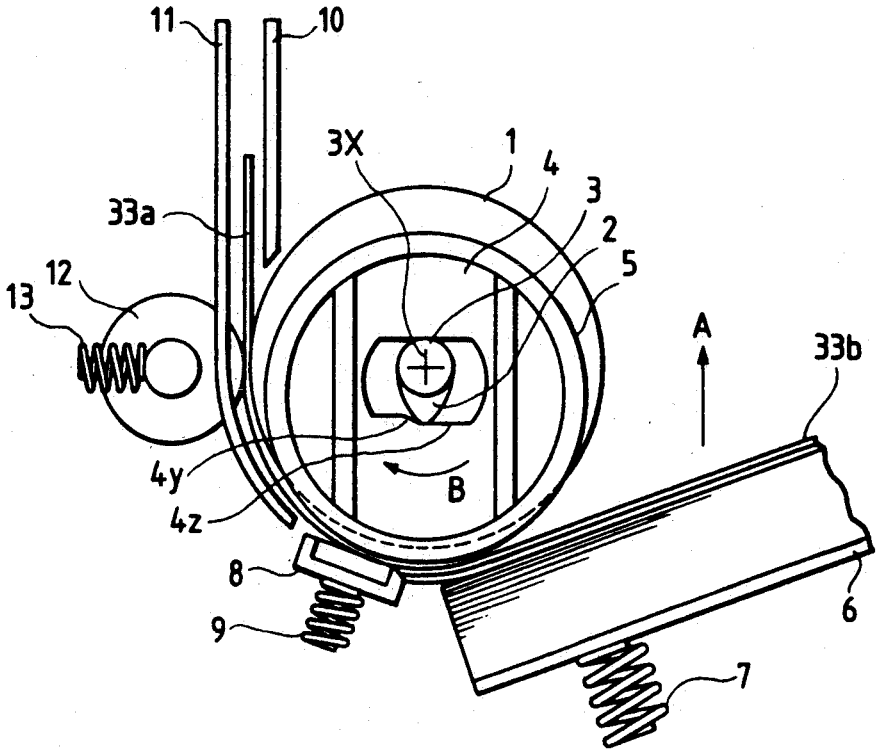
FIG. 10 an illustration of an arrangement of a sheet feeding apparatus according to a fourth embodiment of this invention.
Figure 11:
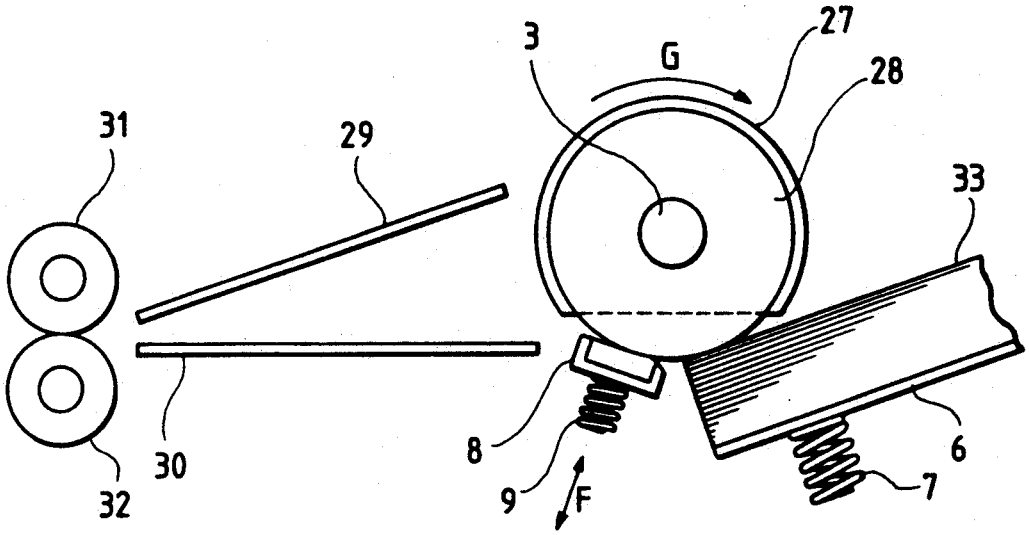
FIG. 11 PRIOR ART
FIGS. 11 to 13 are illustrations for describing an arrangement of a conventional sheet feeding apparatus.
Figure 12:
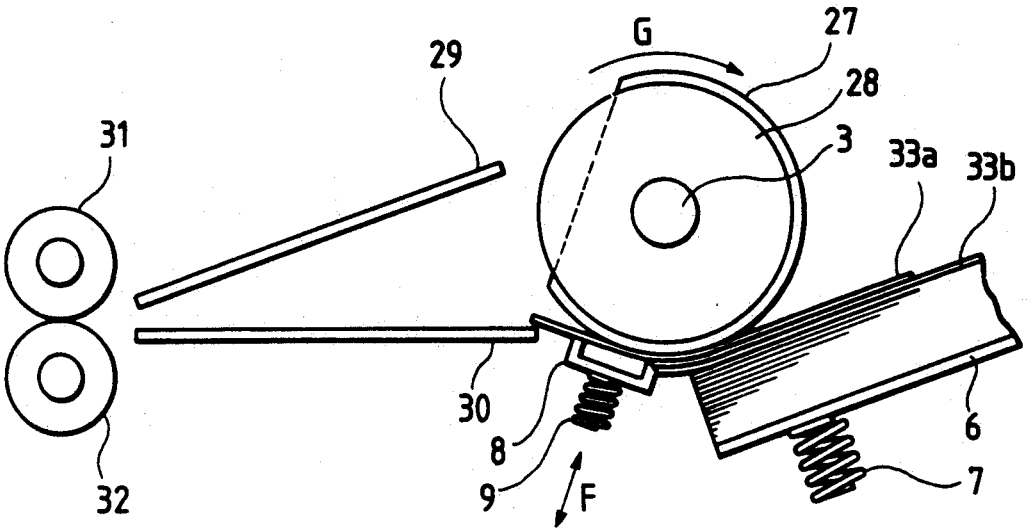
FIG. 12 PRIOR ART
Figure 13:
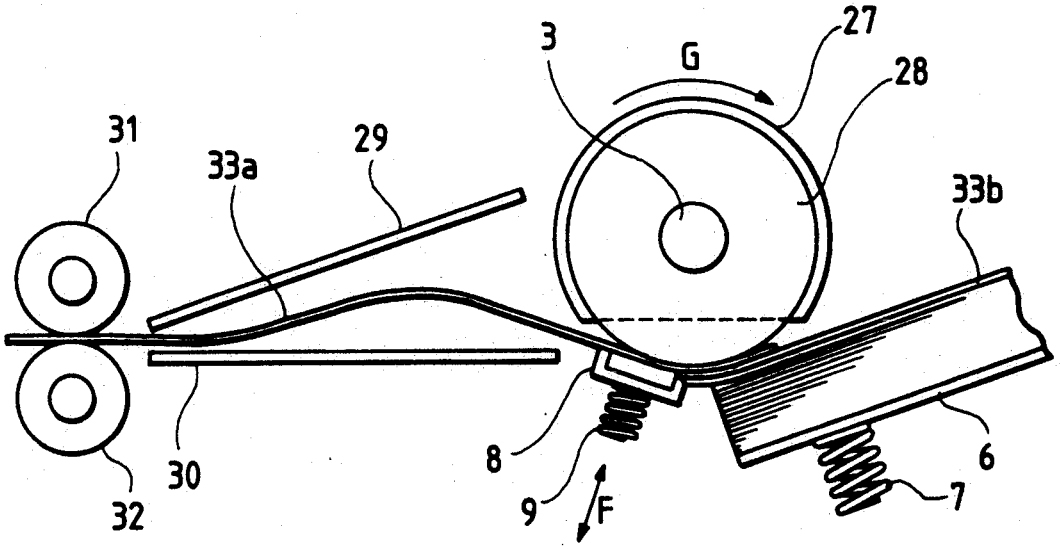
FIG. 13 PRIOR ART

Further, a description will be made hereinbelow with reference to FIG. 10 in terms of a fourth embodiment of this invention. As shown in FIG. 10, in the fourth embodiment a step (difference in height between portions of the cam contacting surface) 4*y* is formed on a cam contacting surface 4*z* of the idler roller bracket assembly 4 which contacts with the cam assembly 2. Similarly, this step 4*y* can prevent the cam assembly 2 from rotating in the arrow B direction when the idler roller bracket assembly 4 is pressed in the arrow A direction in the state that the rotation of the roller rotating shaft 3 is stopping due to the operation of the one-revolution clutch 24. This step 4*y* comprises the cam contacting surface curved about the rotation center point 3*x* of the roller rotating shaft 3 so that its height continuously becomes higher along the arrow B direction.

According to the fourth embodiment, with the step 4*y* being formed on the cam contacting surface of the idler roller bracket assembly 4, it is possible to prevent the separation idler roller assembly 5 from being undesirably released from the pressed state, thereby preventing the undesirable sheet feeding operation. In addition, since the step 4*y* comprises a surface partially curved with respect to the rotation center point 3*x* of the roller rotating shaft 3, the cam assembly 2 can follow the step 4*y* with a relatively small driving force to ensure the smooth rotation.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention. For example, although in the embodiments the sheet feeding roller assembly 1 is released from the contacting state with the sheet 33 in the sheet storing device 6 with the sheet storing device 6 being pressed by means of the cam members 25*a* and 25*b*, it is appropriate that the contact of the sheet feeding roller assembly 1 with the sheet 33 is released by pressing the sheets 33 through the separation idler roller assembly 5.

What is claimed is:

1. A sheet feeding apparatus for successively supplying, by one, sheets piled up within a sheet storing device up to an external apparatus along a predetermined sheet supplying direction, said apparatus comprising:

sheet feeding roller means rotationally driven by driving means;

first pressing means for pressing said sheet storing device toward said sheet feeding roller means so that said sheets can be pressed against said sheet feeding roller means so as to be picked up and fed from said sheet storing device;

separation means disposed at a downstream side of said sheet storing device and in opposed relation to said sheet feeding roller means, said separation means being pressed by a second pressing means toward said sheet feeding roller means to be brought into contact with said sheet feeding roller means so that said sheets picked up from said sheet storing device are pressed against said sheet feeding roller means so as to be frictionally separated from each other and fed by one in accordance with the rotation of said sheet feeding roller means toward a downstream side;

non-driven roller means disposed at a downstream side of said separation means and arranged to be brought into contact with said sheet feeding roller means so as to be rotatable in accordance with the rotation of said sheet feeding roller means, said non-drive roller means, in cooperation with said sheet feeding roller means, further feeding said sheet separated by said separation means to a down stream side;

first releasing means for releasing the pressed state of said sheets within said sheet storing device against said sheet feeding roller means after said sheet separated by said separation means reaches said non-driven roller means; and second releasing means for releasing the pressed state of said separation means against said sheet feeding roller means.

2. A sheet feeding apparatus as claimed in claim 1, wherein said second releasing means releases the pressed state of said separation means at the substantially same time that the pressed state of said sheet storing device is released by said first releasing means.

3. A sheet feeding apparatus as claimed in claim 1, wherein said second releasing means comprises roller means having a through-hole into which said roller rotating shaft of said sheet feeding roller means is inserted, said second releasing roller means being arranged to be movable in a first direction of said separation means and in a second direction opposite to said direction of said separation means so that, when being moved in said first direction of said separation means, said second releasing roller means presses said separation means against said second pressing means to separate said separation means from said sheet feeding roller means.

4. A sheet feeding apparatus as claimed in claim 3, wherein said second releasing roller means is moved in said first and second directions by cam means fixedly attached to said roller rotating shaft of said sheet feeding roller means and positioned within said through-hole of said second releasing roller means, said cam means being arranged to contact with a surface of said through-hole of said second releasing roller means so as to move said second releasing roller means in said first and second directions.

5. A sheet feeding apparatus as claimed in claim 4, wherein said second releasing means has stopper means engageable with said cam means when said roller rotating shaft of said sheet feeding roller means rotates by a predetermined rotational angle to stop the rotation of cam means when a rotational force of said cam means is below a predetermined value.

6. A sheet feeding apparatus as claimed in claim 5, wherein said stopper means comprises a projection formed on said surface of said through-hole.

7. A sheet feeding apparatus as claimed in claim 5, wherein said stopper means comprises a step formed on said surface of said through-hole, said step being arranged such that the height of said surface of said through-hole successively heightens in a direction substantially equal to a direction of the rotation of said cam means occurring in accordance with the rotation of said roller rotating shaft.

8. A sheet feeding apparatus as claimed in claim 7, wherein said step is arranged to form a surface curved with respect to the rotating axis of said roller rotating shaft.

9. A sheet feeding apparatus as claimed in claim 4, wherein said cam means is arranged such that its distal portion has a flat surface.

10. A sheet feeding apparatus as claimed in claim 1, wherein said first releasing means comprises cam means fixedly attached to said roller rotating shaft of said sheet feeding roller means so as to be rotatable in accordance with the rotation of said sheet feeding roller means, said cam means being arranged to press said sheet storing device against said first pressing means when said roller rotating shaft rotates by a predetermined rotational angle so as to release said sheets from the pressed state against said sheet feeding roller means.

11. A sheet feeding apparatus for successively supplying, by one, sheets piled up within a sheet storing device up to an external apparatus along a predetermined sheet supplying direction, said apparatus comprising:

sheet feeding roller means driven by driving means to rotate about a roller rotating shaft;

first pressing means for pressing said sheet storing device toward said sheet feeding roller means so that said sheets can be pressed against said sheet feeding roller means so as to be picked up and fed from said sheet storing device;

separation means disposed at a downstream side of said sheet storing device and in opposed relation to said sheet feeding roller means, said separation means being pressed by a second pressing means toward said sheet feeding roller means to be brought into contact with said sheet feeding roller means so that said sheets picked up from said sheet storing device are pressed against said sheet feeding roller means so as to be frictionally separated from each other and fed by one in accordance with the rotation of said sheet feeding roller means toward a downstream side;

first releasing means operable in accordance with the rotation of said sheet feeding roller means for releasing the pressed state of said sheets against said sheet feeding roller means when said sheet feeding roller means rotates by a first predetermined rotational angle; and second releasing means operable in accordance with the rotation of said sheet feeding roller means for releasing the pressed state of said separation means against said sheet feeding roller means when said sheet feeding roller means rotates by a second predetermined rotational angle.

12. A sheet feeding apparatus as claimed in claim 11, wherein said first predetermined rotational angle is substantially equal to said second predetermined rotational angle.

13. A sheet feeding apparatus as claimed in claim 11, wherein said second releasing means comprises roller means having a through-hole into which said roller rotating shaft of said sheet feeding roller means is inserted, said second releasing roller means being arranged to be movable in a first direction of said separation means and in a second direction opposite to said direction of said separation means so that, when being moved in said first direction of said separation means, said second releasing roller means presses said separation means against said second pressing means to separate said separation means from said sheet feeding roller means.

14. A sheet feeding apparatus as claimed in claim 13, wherein said second releasing roller means is moved in said first and second directions by cam means fixedly attached to said roller rotating shaft of said sheet feeding roller means and positioned within said through-hole of said second releasing roller means, said cam means being arranged to contact with a surface of said through-hole of said second releasing roller means so as to move said second releasing roller means in said first and second directions.

15. A sheet feeding apparatus as claimed in claim 14, wherein said cam means is arranged such that its distal portion has a flat surface.

16. A sheet feeding apparatus as claimed in claim 14, wherein said second releasing means has stopper means engageable with said cam means when said roller rotating shaft of said sheet feeding roller means rotates by said second predetermined rotational angle to stop the rotation of cam means when a rotational force of said cam means is below a predetermined value.

17. A sheet feeding apparatus as claimed in claim 16, wherein said stopper means comprises a projection formed on said surface of said through-hole.

18. A sheet feeding apparatus as claimed in claim 16, wherein said stopper means comprises a step formed on said surface of said through-hole, said step being arranged such that the height of said surface of said through-hole successively heightens in a direction substantially equal to a direction of the rotation of said cam means occurring in accordance with the rotation of said roller rotating shaft.

19. A sheet feeding apparatus as claimed in claim 18, wherein said step is arranged to form a surface curved with respect to the rotating axis of said roller rotating shaft.

20. A sheet feeding apparatus as claimed in claim 11, wherein said first releasing means comprises cam means fixedly attached to said roller rotating shaft of said sheet feeding roller means so as to be rotatable in accordance with the rotation of said sheet feeding roller means, said cam means being arranged to press said sheet storing device against said first pressing means when said roller rotating shaft rotates by a predetermined rotational angle so as to release said sheets from the pressed state against said sheet feeding roller means.

* * * * *